US005746046A

United States Patent [19]

McCartney et al.

[11] Patent Number: 5,746,046

[45] Date of Patent: May 5, 1998

[54] METHOD FOR FORMING COMINGLED COMPOSITE YARN

[75] Inventors: Phillip D. McCartney, Oak Ridge; McDaniel L. Beard, Burlington; Elaine V. Inman, Summerfield, all of N.C.

[73] Assignee: Guilford Mills, Inc., Greensboro, N.C.

[21] Appl. No.: 693,873

[22] Filed: Aug. 5, 1996

[51] Int. Cl.[6] ..... D02G 1/20

[52] U.S. Cl. ..... 57/350; 57/244; 57/245; 57/908

[58] Field of Search ..... 57/908, 243, 244, 57/245, 252, 254, 350, 351; 28/172.2, 194

[56] References Cited

U.S. PATENT DOCUMENTS

| | | | |
|---|---|---|---|
| 2,911,704 | 11/1959 | Brown | 57/244 X |
| 3,069,836 | 12/1962 | Dahlstrom et al. | 57/908 X |
| 3,444,681 | 5/1969 | Reese | 57/140 |
| 3,972,174 | 8/1976 | London, Jr. et al. | 57/908 X |
| 4,248,036 | 2/1981 | Barron | 57/244 X |
| 4,332,757 | 6/1982 | Blackmon et al. | 264/103 |
| 4,332,758 | 6/1982 | Blackmon et al. | 264/103 |
| 4,345,424 | 8/1982 | Davis et al. | 57/908 X |
| 4,381,335 | 4/1983 | Okamoto | 428/373 |
| 4,437,301 | 3/1984 | Eschenbach et al. | 57/908 X |
| 4,464,894 | 8/1984 | Leininger | 57/908 X |
| 4,467,594 | 8/1984 | Eschenbach | 57/908 X |
| 4,567,720 | 2/1986 | Price | 57/207 |
| 4,596,742 | 6/1986 | Selivansky et al. | 428/373 |
| 4,610,131 | 9/1986 | Eschenbach et al. | 57/350 X |
| 4,615,167 | 10/1986 | Greenberg | 57/350 |
| 4,721,650 | 1/1988 | Nunning et al. | 428/369 |
| 4,788,816 | 12/1988 | Clements et al. | 57/908 X |
| 4,969,322 | 11/1990 | Sasaki et al. | 57/244 |
| 4,993,218 | 2/1991 | Schwartz et al. | 57/908 X |
| 5,032,233 | 7/1991 | Bankar | 264/103 |
| 5,137,666 | 8/1992 | Knox et al. | 264/103 |
| 5,172,459 | 12/1992 | Goineau | 28/240 |
| 5,234,645 | 8/1993 | Grindstaff | 264/103 |
| 5,242,640 | 9/1993 | Butler et al. | 264/103 |

*Primary Examiner*—John M. Jillions
*Assistant Examiner*—Tina R. Taylor
*Attorney, Agent, or Firm*—Kennedy Covington Lobdell & Hickman, L.L.P.

[57] ABSTRACT

A composite yarn and a method for forming the composite yarn include the composite yarn being formed from different components wherein the resultant yarn exhibits characteristics not apparent from the individual component yarns with the composite yarn being formed from a first component yarn strand and a second component yarn strand with the first and second component strands being comingled using an entanglement device with the co-mingling occurring with the first and second component strands subject to a first tension value which is subsequently increased to a second, higher tension value for winding. A method for forming such a composite yarn includes propelling the strands through the entanglement device at a first tension value, entangling the strands, imparting a second tension value to the resultant entangled strands and winding the entangled strands.

15 Claims, 2 Drawing Sheets

METHOD FOR FORMING COMINGLED COMPOSITE YARN

BACKGROUND OF THE INVENTION

The present invention relates broadly to composite yarns formed from two or more strands or filaments of different material. More particularly, the present invention relates to a comingled composite yarn formed by two or more strands or filaments of different material which are comingled in an entanglement device under relatively low tension, and the method for forming such a yarn.

It is generally known to form fabric with yarn which has been texturized, i.e., given some sort of surface irregularity to impart a predetermined hand to the fabric. Among particular textures, crepe is in wide use. Crepe refers generally to fabrics made from a variety of materials, both natural and synthetic, which are characterized by a broad range of crinkled or grained surface effects. Common methods of forming crepe include the use of hard, twisted yarns, special chemical treatments, special weaves, and embossing. Crepe fabric may be used for swimwear, intimate wear, outerwear, brushed fabrics, and auto upholstery. Crepe is popular for its comfort, durability, and variety of applications.

It is known generally to achieve texturized yarn using air entanglement jets. For example, in Price U.S. Pat. No. 4,567,720, an air texturization system is introduced which provides a method and apparatus for producing air jet texturized yarns with substantially no unstable or wild loops. There, bulky or crimped yarns composed of continuous synthetic fiber-forming polymers such as polyester and polyamide are produced by feeding yarn filaments with overfeed to an air jet texturizer to produce a larger number of random loops or crimps in the yarn. The type and degree of texture can be controlled by altering the relative speed of the yarns passing through the entanglement jet, i.e., the amount of "overfeed". Texture can also be produced by introducing a twist to the yarn. In Price, the properties of a partially oriented synthetic polymeric feed yarn are altered prior to texturization in a cold drawing process. This yarn is combined with a core and effect yarn to produce a texturized yarn with substantially no unstable loops.

Reese U.S. Pat. No. 3,444,681 is directed to a bulked yarn formed from a continuous-filament polyester components having different shrinkage characteristics which cause the composite yarn to bulk when shrunk. The advantages to Price '681 are most pronounced when the yarns are bulked subsequent to their conversion of fabrics and preferably after the fabrics are scoured and dyed. Reese '681 combines two polyester filaments having essentially the same chemical compositions with different boil-off shrinkages. Reese '681 advocates a hot water bath to shrink a combined yarn without the use of air entanglement.

SUMMARY OF THE INVENTION

It is accordingly an object of the present invention to provide a comingled yarn having characteristics unapparent from the individual component yarns.

It is further an object of the present invention to achieve such a resultant yarn using air entanglement jets.

To that end, a method for forming a composite yarn from differential component yarns wherein the resultant yarn exhibits characteristics not apparent from individual component yarns includes the steps of providing a textile machine having an assembly for imparting movement to strand for travel therethrough for yarn forming operations, an assembly for controlling strand tension and a device for entangling two or more strands; providing a first creeled component strand for travel through the textile machine and providing a second creel component strand for traveling through the textile machine. The method further includes the steps of imparting movement to the first and second component strands using the textile machine for propelling the first and second strands therethrough; directing the first and second component strands to the entanglement device at a first tension value; entangling the first and second component strands using the entanglement device thereby forming a resultant yarn strand; imparting a second tension value to the resultant yarn strand with the second tension value being greater than the first tension value and winding the resultant yarn strand on a winder at the second tension value.

The step of directing the first and second component strands to the entanglement device at a first tension value preferably includes imparting the first tension value in the range of 4 to 11 grams to the first and second component strands. It is further preferred that a pair of tension rollers be disposed downstream of the entanglement device with respect to yarn travel. The method further preferably comprises the step of winding the resultant yarn onto a warp beam at the second tension value which is preferably in the range of 0.10 to 0.35 grams per denier. The tension control rollers are disposed intermediate the entanglement device and the winder so that the tension on the filaments or strands going through the air entanglement device are reduced relative to the tension imposed on the yarn during winding.

Several combinations of materials are particularly adaptive to use with the method of the present invention. Accordingly, several preferred embodiments exist, each of which produces satisfactory results. It is preferred that the step of providing the first and second component strands includes providing a first component strand formed from acetate and a second component strand formed from nylon. In another preferred embodiment, the first component strand is formed from a partially oriented yarn, while the second component strand is formed from fully oriented yarn. The term "partially oriented yarn" is used herein to describe a polymeric yarn which is drawn to an extent rendering its molecules in a partial orientation. A "partially drawn yarn" is drawn to a lesser extent than is a "fully drawn yarn." The term "fully oriented yarn" means a polymeric yarn drawn to such an extent that its molecules are fully oriented and very little additional extensibility is possible without breaking. Fully oriented yarn is the most stable yarn condition. Nevertheless, the resilience of partially oriented yarn is improved over fully oriented yarn, resulting in improved wrinkle resistance in fabrics made from such yarn.

It is also preferred that the first component strand be formed from polyester and the second component strand be formed from acetate. Another preferred embodiment includes providing a first component strand formed from polypropylene and a second component strand formed from acetate. The first component strand may also be preferably nylon while the second component strand be formed from polypropylene. Polypropylene and polyester may also be used to form an additional preferred embodiment. Another specific preferred embodiment uses a first component formed from polyester and a second component strand formed from nylon. In a more general sense, it is preferred that the step of providing first and second component strands includes providing a first component strand formed from a material having first shrinkage characteristics and a second component strand formed from material having second shrinkage characteristics with the second shrinkage characteristics being different from the first shrinkage characteristics. It is also preferred that the first component strand be formed from polyester while the second component strand is formed from a natural fiber.

The present invention is also directed to a composite yarn formed according to the previously described method wherein the resultant yarn exhibits characteristics not apparent from the individual yarn components. According to the composite yarn of the present invention, any of the combinations of first and second component strands may be used. Further, the combination of low tension entanglement and high tension winding characterizes the method of forming the component yarn of the present invention.

DESCRIPTION OF THE PREFERRED EMBODIMENT

Figure 1:
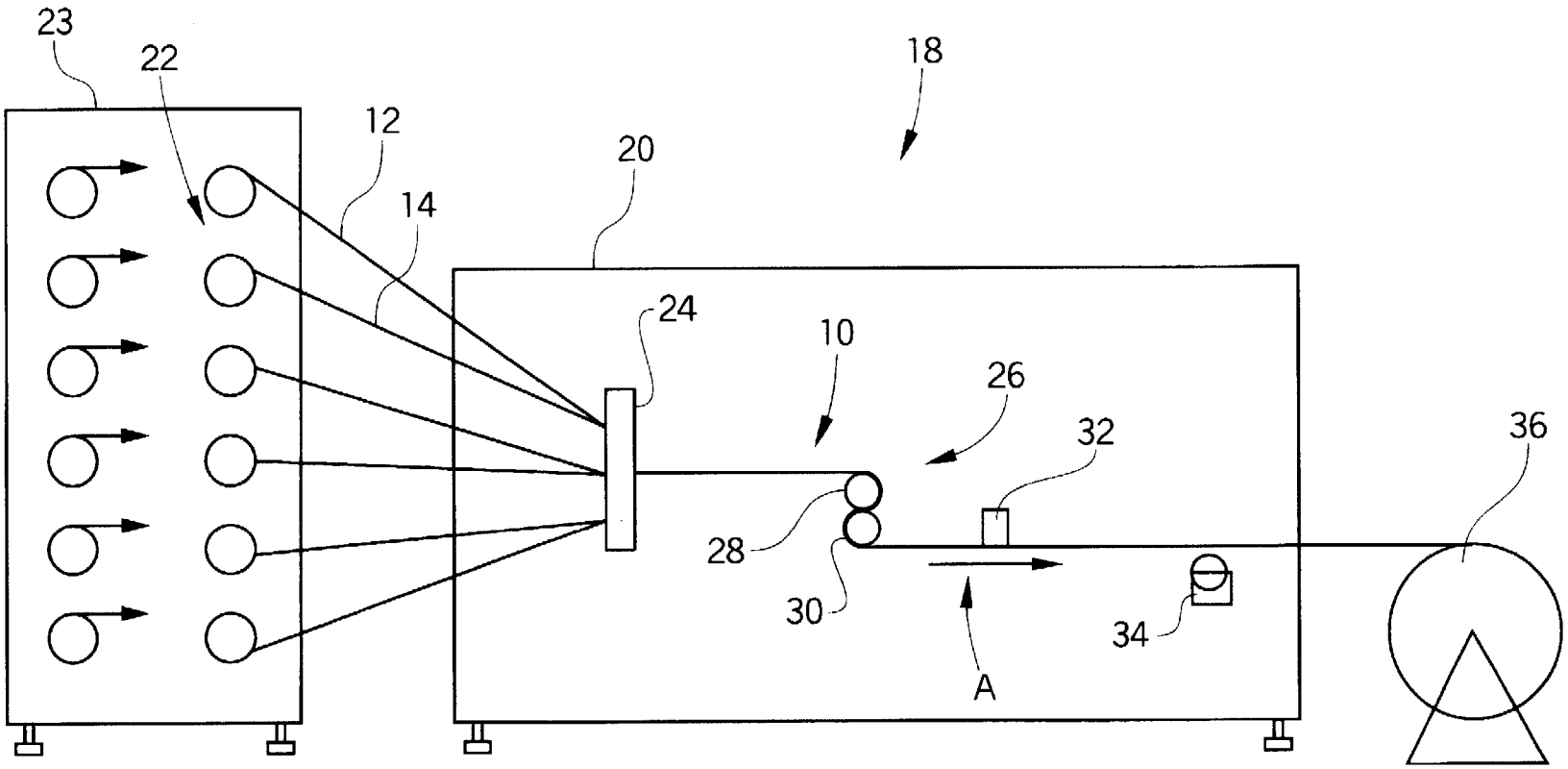
FIG. 1 is a diagrammatic illustration of an apparatus used to carry out the preferred embodiments of the method according to the present invention.

Turning now to the drawings and, more particularly to FIG. 1, an apparatus for forming the yarn of the present invention according to the preferred embodiment of the method of the present invention is illustrated generally at 18 and includes a textile machine 20 and a creel frame 23 for yarn supply. The apparatus 18 is shown in diagrammatic form for simplicity of illustration. It should be noted that the components used to carry out the method of the present invention are known to those skilled in the art of yarn formation and winding and will not be described in great detail. The apparatus also includes a textile machine 20 for processing filaments and creating yarn therefrom. The textile machine 20 includes an air entanglement jet which may be a Liba LH jet entangling unit or a Mayer entangling reel. At least two tension rollers 28,30 are disposed downstream with respect to yarn travel from the entanglement jet 24 and form a tension control apparatus 26. Downstream from the tension control apparatus 26, a yarn inspector is mounted to the textile machine followed by an oven oiler. Finally, a winder 36, which may be a beam warper, is disposed downstream from the prior described apparatus for winding the yarn formed on the textile machine 20. While the textile machine 20 and the creeling frame 23 are shown separately from the beam warper 36, it should be noted that these functions may all be combined to form a singular machine which can completely form and wind yarn without departing from the spirit and scope of the present invention.

The yarn is shown generally at 10 and includes first and second component strands 12,14. It will be understood by those skilled in the art of yarn formation that two or more filaments may be combined to form the resultant yarn. It is important that at least two filaments be of differing material. The strands or filaments are disposed on creels 22 which are rotatably mounted to the creel frame 23 in a manner for payout of yarn components 12,14 upon demand from the textile machine 20. By proper thread-up of the components 12,14 to the entanglement jet 24, to be trained around the rollers 28,30 forming the tension assembly, past the yarn inspector 32, and the oiler oven 34 onto the beam warper 36, the yarn defines a yarn travel path indicated by an arrow A. By applying power to the tension rollers 28,30 and the beam warper 36, the yarn may be caused to travel along the path A.

Figure 2:
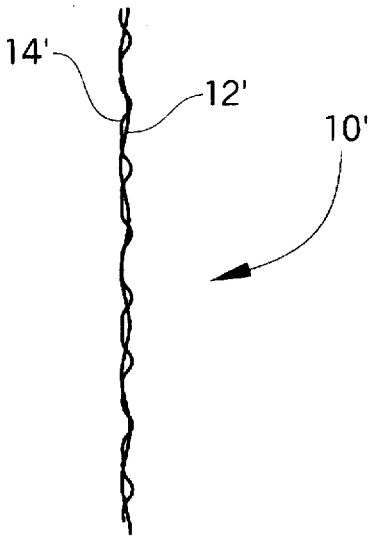
FIG. 2 is a diagrammatic representation of a composite yarn according to one preferred embodiment of the present invention.
Figure 3:
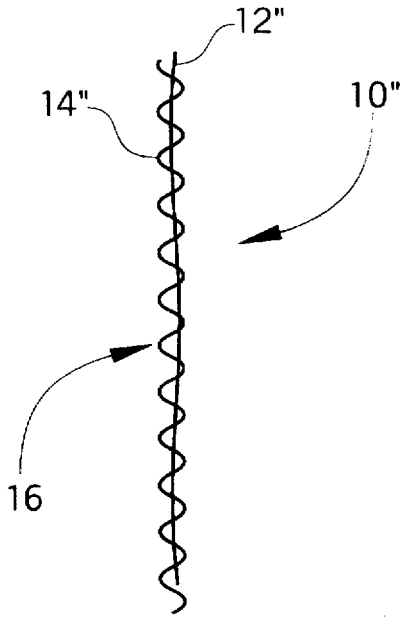
FIG. 3 is a diagrammatic representation of a composite yarn formed according to a second preferred embodiment of the present invention.

FIGS. 2 and 3 illustrate examples of resultant yarns in a general, diagrammatic form. FIG. 2 includes a general form of texturized yarn 10' which includes first and second component strands 12',14'. FIG. 3 is directed to a crepe yarn 10" which is formed from yarns having differential shrinkage characteristics. The crepe effect 16 results from component yarns 12",14" which have been processed according to the method of the present invention and after having the differential shrinkage imposed. The component with the greater shrinkage factor acts as a core yarn for the effect component 14' which creates the noted "puffy" crepe effect.

According to the method of the present invention, and after thread-up of the yarn, the component yarns 12,14 are paid out from the creels 22 into the entanglement device 24. There, under high pressure air conditions, the component yarns are entangled with one another. From the entanglement jets, the yarn is drawn off and caused to travel through the tension control apparatus 26. With the second roll 30 rotating at a faster rate than the first roll 28, the tension on the yarn 10 exiting the entanglement device 24 is less than the tension of the yarn entering the beam warper. The initial tension value should be in the range of 0.5 to 0.30 grams per denier the final tension value should be in the range of 0.1 to 0.35 grams per denier, with the denier being in the range generally between 40 and 170.

The resultant yarn exhibits characteristics neither anticipated nor suspected given the properties of the individual component yarns. By way of example, an acetate and nylon combination with a denier of 98.2 exhibit 37.0% elongation and a resultant tenacity of 1.44 grams per denier. The BWS is 4.4%. A POY nylon combination with a denier of 109.6 resulted in an elongation of 46.4% with a resultant tenacity of 1.96 grams per denier and a BWS of 44.4%. It is noted that the stress-strain curve follows the properties of the weakest yarn. The tenacities of the aforementioned yarns follow the acetate and the POY and not the nylon. The strain-strain curve of the POY nylon combination is of particular interest because the nylon breaks at 46% extension while the polyester POY continues to extend thereby giving a "double break".

The resultant comingled yarns do not exhibit the same yarn properties as the individual component yarns which tend to exhibit a composite of yarn properties which tend toward the weakest of the components. The elongation, usually measured at the first filament break, follows closely the weakest component. However, the stress-strain curve does not end when one of the component yarns is broken, but rather continues until the other component yarn breaks exhibiting a unique property curve.

Boiling water shrinkage takes on the highest value rather than an average, which is unexpected. The denier is not an addition to the components but is slightly higher, which may be expected had the yarn any bulk. The present invention provides a slight bulking of the yarn to about 3.5%. The tenacity of the combination follows the weakest component.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for forming a composite yarn from differential component yarns wherein the resultant yarn exhibits characteristics not apparent from the individual component yarns, said method comprising the steps of:

providing a textile machine having means for imparting movement to strands for travel through said textile machine for yarn forming operations, means for controlling strand tension and means for entangling two or more strands;

providing a first creeled component strand for travel through said textile machine;

providing a second creeled component strand for travel through said textile machine;

imparting movement to said first and second component strands using said textile machine for propelling said first and second strands therethrough;

directing said first and second component strands to said entanglement means at a first tension value, said first tension value being imposed on said strands by said means for controlling strand tension;

entangling said first and second component strands using said entanglement means thereby forming a resultant yarn strand;

imparting a second tension value to said resultant yarn strand, said second tension value being greater than said first tension value and imparted by said means for controlling strand tension;

winding said resultant yarn strand on a winder at said second tension value.

2. A method for forming a composite yarn according to claim 1 wherein the step of directing said first and second component strands to said entanglement means at a first tension value includes imparting said first tension value in the range of 0.05 to 0.30 grams per denier to said first and second component strands.

3. A method for forming a composite yarn according to claim 2 wherein said step of providing a textile machine includes providing a textile machine with said means for controlling strand tension including a pair of tension control rollers downstream of said entanglement device with resect to yarn travel.

4. A method for forming a composite yarn according to claim 1 and further comprising the step of winding said resultant yarn onto a warp beam at said second tension value.

5. A method for forming a composite yarn according to claim 4 wherein said second tension value is in the range of 0.10 to 0.35 grams per denier.

6. A method for forming a composite yarn according to claim 1 wherein said step of providing a textile machine having means for entangling two or more strands includes providing a textile machine wherein said means for entangling two or more strands includes a jet entanglement device.

7. A method for forming a composite yarn according to claim 1 wherein said step of providing first and second component strands includes providing a first component strand formed from acetate and a second component strand formed from nylon.

8. A method for forming a composite yarn according to claim 1 wherein said step of providing first and second component strands includes providing a first component strand formed from partially oriented yarn and a second component strand formed from fully oriented yarn.

9. A method for forming a composite yarn according to claim 1 wherein said step of providing first and second component strands includes providing a first component strand formed from polyester and said a second component strand formed from acetate.

10. A method for forming a composite yarn according to claim 1 wherein said step of providing first and second component strands includes providing a first component strand formed from polypropylene and a second component strand formed from acetate.

11. A method for forming a composite yarn according to claim 1 wherein said step of providing first and second component strands includes providing a first component strand formed from nylon and a second component strand formed from polypropylene.

12. A method for forming a composite yarn according to claim 1 wherein said step of providing first and second component strands includes providing a first component strand formed from polypropylene and a second component strand formed from polyester.

13. A method for forming a composite yarn according to claim 1 wherein said step of providing first and second component strands includes providing a first component strand formed from polyester and a second component strand formed from nylon.

14. A method for forming a composite yarn according to claim 1 wherein said step of providing first and second component strands includes providing a first component strand formed from a material having first shrinkage characteristics and a second component strand formed from a material having second shrinkage characteristics, said second shrinkage characteristics being different from said first shrinkage characteristics.

15. A method for forming a composite yarn according to claim 14 wherein said step of providing first and second component strands includes providing a first component strand formed from polyester and a second component strand formed from a natural fiber.

* * * * *